US010913039B2

(12) United States Patent
Govyadinov et al.

(10) Patent No.: US 10,913,039 B2
(45) Date of Patent: Feb. 9, 2021

(54) MICROFLUIDIC MIXER

(71) Applicant: HEWLETT-PACKARD DEVELOPMENT COMPANY, L.P., Houston, TX (US)

(72) Inventors: Alexander Govyadinov, Corvallis, OR (US); Pavel Kornilovich, Corvallis, OR (US); Erik D. Torniainen, Corvallis, OR (US); David P. Markel, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 315 days.

(21) Appl. No.: 16/300,975

(22) PCT Filed: Jul. 6, 2016

(86) PCT No.: PCT/US2016/041106
§ 371 (c)(1),
(2) Date: Nov. 13, 2018

(87) PCT Pub. No.: WO2018/009184
PCT Pub. Date: Jan. 11, 2018

(65) Prior Publication Data
US 2020/0030760 A1 Jan. 30, 2020

(51) Int. Cl.
*B01F 5/00* (2006.01)
*B01F 13/00* (2006.01)
(Continued)

(52) U.S. Cl.
CPC ..... *B01F 13/0059* (2013.01); *B01F 5/0057* (2013.01); *B01F 15/0243* (2013.01);
(Continued)

(58) Field of Classification Search
CPC ..... B01F 11/0071; B01F 11/0077; B01F 13/0059; B01F 15/0243; B01F 2005/0034;
(Continued)

(56) References Cited

U.S. PATENT DOCUMENTS 6,065,864 A 5/2000 Evans et al.
6,858,185 B1 2/2005 Kopf-Sill
(Continued)

FOREIGN PATENT DOCUMENTS

CN 102145265 8/2011
EP 1652575 5/2006
(Continued)

OTHER PUBLICATIONS

Mansur, E. A. et al.; A State-of-the-art Review of Mixing in Microfluidic Mixers; The State Key Laboratory of Chemical Engineering, Department of Chemical Engineering, Tsinghua University, Beijing 100084, China: Aug. 4, 2008.
(Continued)

*Primary Examiner* — Jennifer Wecker
(74) *Attorney, Agent, or Firm* — Perry + Currier Inc

(57) ABSTRACT

One example provides a microfluidic mixing device that includes a main fluidic channel to provide main fluidic channel flow and a number of I-shaped secondary channels extending outwardly from a portion of the main fluidic channel. A number of inertial pumps are located within the I-shaped secondary channels to create serpentine flows in the direction of the main fluidic channel flow or create vorticity-inducing counterflow in the main fluidic channel.

12 Claims, 10 Drawing Sheets

(51) Int. Cl.

| | |
|---|---|
| ***G01N 35/08*** | (2006.01) |
| ***B81B 1/00*** | (2006.01) |
| ***B01L 3/00*** | (2006.01) |
| ***B01F 15/02*** | (2006.01) |
| *B01F 3/08* | (2006.01) |
| *G01N 35/10* | (2006.01) |

(52) U.S. Cl.
CPC ..... *B01L 3/50273* (2013.01); *B01F 2005/004* (2013.01); *B01F 2005/0034* (2013.01); *B01F 2005/0054* (2013.01); *B01F 2215/0037* (2013.01); *B01L 2400/0475* (2013.01)

(58) Field of Classification Search
CPC ..... B01F 2005/004; B01F 2005/0054; B01F 2215/0037; B01F 5/0057; B01L 2400/0475; B01L 3/50273
See application file for complete search history.

(56) References Cited

U.S. PATENT DOCUMENTS

| | | | |
|---|---|---|---|
| 7,763,453 | B2 | 7/2010 | Clemmens et al. |
| 8,157,434 | B2 | 4/2012 | Cohen et al. |
| 8,210,209 | B2 | 7/2012 | Gilbert et al. |
| 8,277,112 | B2 | 10/2012 | Bhopte |
| 8,696,898 | B2 | 4/2014 | Meese |
| 9,211,539 | B2 | 12/2015 | Amin et al. |
| 2008/0259720 | A1 | 10/2008 | Lam et al. |
| 2008/0316854 | A1 | 12/2008 | Wang et al. |
| 2009/0087859 | A1 | 4/2009 | Johnson |
| 2011/0286493 | A1 | 11/2011 | Torniainen et al. |
| 2012/0070833 | A1 | 3/2012 | Wang |
| 2012/0136492 | A1 | 5/2012 | Amin et al. |
| 2012/0244604 | A1 | 9/2012 | Kornilovich et al. |
| 2012/0300576 | A1 | 11/2012 | Li et al. |
| 2013/0164854 | A1 | 6/2013 | Wang et al. |
| 2013/0344617 | A1 | 12/2013 | Robertson |
| 2014/0134623 | A1 | 5/2014 | Hiddessen et al. |
| 2014/0377145 | A1* | 12/2014 | Govyadinov ..... B01F 13/0059 422/505 |
| 2015/0190767 | A1 | 7/2015 | Govyadinov et al. |

FOREIGN PATENT DOCUMENTS

| | | | |
|---|---|---|---|
| JP | 2008-537904 | A | 10/2008 |
| RU | 2403962 | | 11/2010 |
| TW | 200412482 | A | 7/2004 |
| TW | 201028686 | A | 8/2010 |
| TW | 201325707 | A | 7/2013 |
| WO | WO-2009118689 | | 10/2009 |
| WO | WO-2012154688 | | 11/2012 |

OTHER PUBLICATIONS

Tsai, H. et al., Active Microfluidic Mixer and Gas Bubble Filter Driven by Thermal Bubble Micropump, Apr. 1, 2002, < http://www.me.berkeley.edu/~lwlin/papers/jhtsaiS%26A.pdf >.

* cited by examiner

MICROFLUIDIC MIXER

BACKGROUND

Fluid mixing may behave differently at microscales than at macroscales. The ability to mix fluids at microscale may be applied in a variety of industries, such as printing, food, biological, pharmaceutical, and chemical industries. Microfluidic mixing devices may be used within these industries to provide miniaturized environments that facilitate the mixing of small sample volumes such as in chemical synthesis, biomedical diagnostics, drug development, and DNA replication. Microfabrication techniques enable the fabrication of small-scale microfluidic mixing devices on a chip. Enhancing the efficiency of such microfluidic mixing devices may be beneficial for increasing the throughput and reducing the cost of various microfluidic systems, such as bio-chemical micro reactors and lab-on-chip systems.

DETAILED DESCRIPTION

Figure 1:
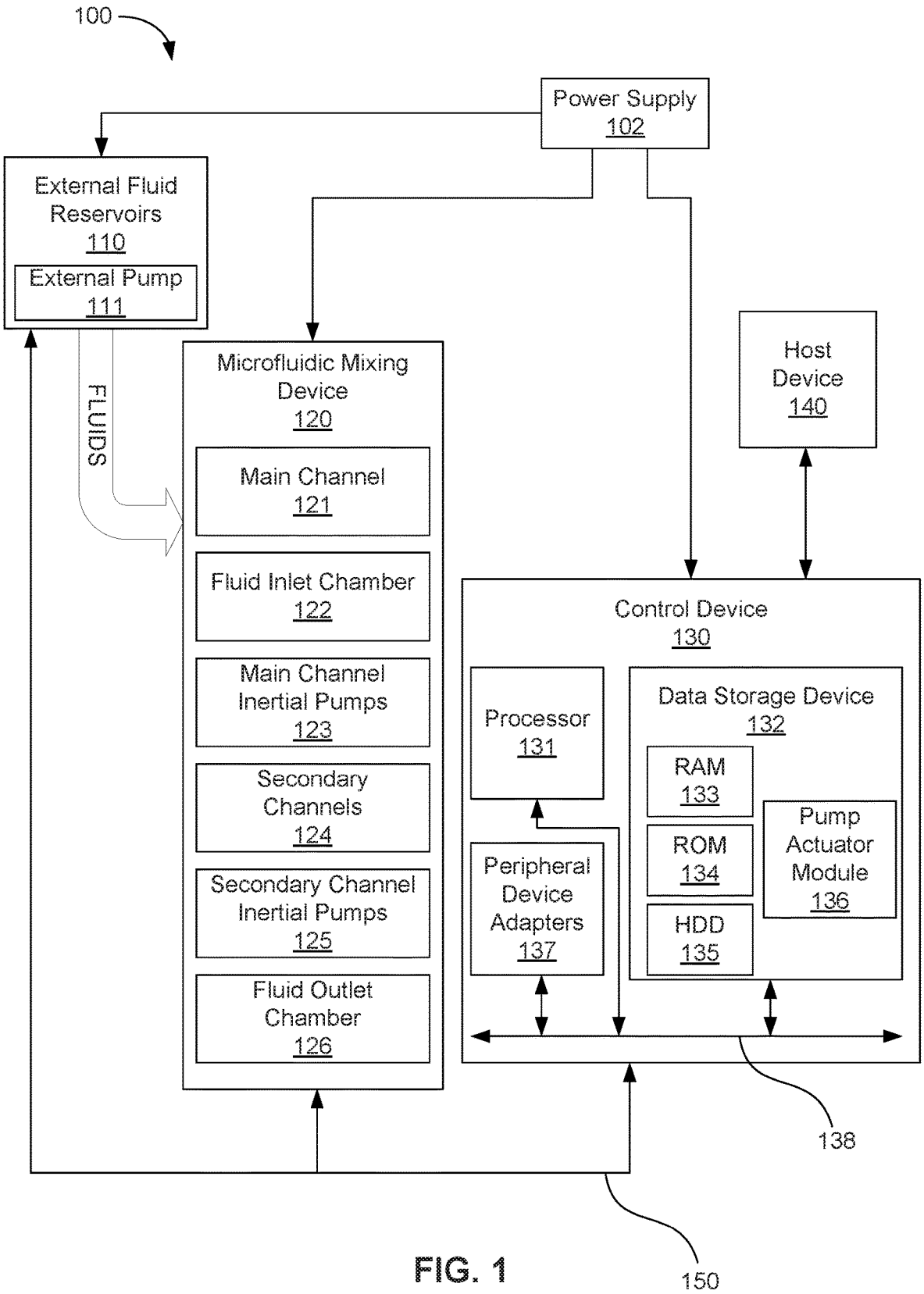
FIG. 1 is a block diagram of an example of a microfluidic mixing system, according to an example of the principles described herein.

At least one example of this disclosure describes systems and methods for mixing fluids within a microfluidic mixing device that use a number of secondary channels that extend from a main channel of a microfluidic mixing device. The secondary channels include secondary-channel inertial pumps located within the secondary channels to pump fluids through the secondary channels to create additional and more effective instances of displacement and transverse flows within the fluids introduced into the microfluidic mixing device for mixing.

As used herein, the term "fluid" is meant to be understood broadly as any substance, such as, for example, a liquid or gas, that is capable of flowing and that changes its shape at a steady rate when acted upon by a force tending to change its shape. In one example, any number of fluids may be mixed within a microfluidic mixing device described herein to obtain a mixed fluid including portions of the fluids introduced into the microfluidic mixing device. As a further example, the fluids mixed in the microfluidic devices may include two or more fluids, fluids including pigments or particles within a single host fluid, or combinations thereof.

Also, as used herein, the term "microfluidic" is meant to be understood to refer to devices and/or systems having flow and/or mixing channels sufficiently small (e.g., less than a few millimeters, including down to the nanometer range) in size that surface tension, energy dissipation, and fluidic resistance factors start to dominate the system. Additionally, the Reynolds number becomes low, and side-by-side fluids in a straight channel flow laminarly rather than turbulently. In some examples, the main microfluidic channel is less than one millimeter in width as measured at a cross-section normal to the net direction of flow through the main microfluidic channel. In other examples, the width of the main microfluidic channel is less than 500 microns, such as less than 200 microns or less than 100 microns.

Further, as used herein, the term "transverse flow" refers to two or more flows of fluids whose directions are non-parallel. For example, transverse flows may be angled relative to each other at acute angles, obtuse angles, 90° angles, directly opposite each other at 180°, or any angle therebetween. Fluids flowing in a non-parallel manner mix more effectively than fluids flowing in a parallel manner.

Still further, as used in the present specification and in the appended claims, the term "counterflow" refers to two or more flows of fluids whose directions are at obtuse angles up to and including directly opposite each other. Fluids flowing in an antiparallel or largely antiparallel manner experience vorticity generation that can be more effective at mixing in the main channel than types of flow that do not generate such vortices.

Further still, as used herein, the term "I-shaped" means shaped like the capital letter "I" without serifs or embellishments, and particularly when used with reference to a channel, means extending linearly, without substantial deviation in direction and without appreciable appendages, crevices, U-bends, etc. As such, no part of a "u-shaped" channel or "m-shaped" channel should be considered an I-shaped channel.

Even still further, as used herein, the term "a number of" or similar language is meant to be understood as including any positive integer.

Turning now to the figures, FIG. 1 is a block diagram depicting an example of a microfluidic mixing system 100. The microfluidic mixing system 100 implements the mixing of fluids through a microfluidic mixing device 120 and processor-implemented mixing methods, as disclosed herein. The microfluidic mixing system 100 includes a number of external fluid reservoirs 110 to supply fluids (e.g., fluidic components/samples, solutions, or a combination thereof) to the mixing device 120 for mixing. In one example, the microfluidic mixing system 100 may include an external pump 111 as part of the external fluid reservoirs 110, or as a stand-alone pump fluidly coupled to the external fluid reservoirs 110. The microfluidic mixing device 120 includes a main channel 121, a fluid inlet chamber 122, a number of main-channel inertial pumps 123, a number of secondary channels 124, a number of secondary-channel inertial pumps 125, and a fluid outlet chamber 126.

In one example, the microfluidic mixing device 120 and its elements may be implemented as a chip-based mixing device that includes the main microfluidic mixing channel 121 for mixing two or more fluids as the fluids flow through the main channel 121, for mixing pigments or particles within a single host fluid as the host fluid flows through the main channel 121, or combinations thereof. The structures and components of the chip-based microfluidic mixing device 120 may be fabricated, for example, using a number of integrated circuit microfabrication techniques, such as electroforming, laser ablation, anisotropic etching, sputtering, dry and wet etching, photolithography, casting, molding, stamping, machining, spin coating, laminating, among others, and combinations thereof.

The microfluidic mixing system 100 also includes a control device 130 to control various components and functions of the system 100, such as the microfluidic mixing device 120, the external fluid reservoir(s) 110, and the external pump 111. In one example, control device 130 controls various functions of the microfluidic mixing device 120. For instance, control device 130 controls the sequence and timing of activation for inertial pumps (123, 125) within the mixing device 120 to mix fluid within the mixing device 120 and to move fluid through the mixing device 120. In another example, the control device 130 controls various functions of the external fluid reservoirs 110 and external pump 111 to introduce a number of fluids into the microfluidic mixing device 120.

To achieve its desired functionality, the control device 130 includes various hardware components. Among these hardware components may be a processor 131, a data storage device 132 and a number of peripheral device adapters 137. The hardware components can further include other devices for communicating with and controlling components and functions of microfluidic mixing device 120, external fluid reservoirs 110, external pump 111 and other components of microfluidic mixing system 100. These hardware components may be interconnected through the use of a number of busses and/or network connections. In one example, the processor 131, data storage device 132, peripheral device adapters 137 may be communicatively coupled via bus 138.

The processor 131 may include the hardware architecture to retrieve executable code from the data storage device 132 and execute the executable code. The processor can include a number of processor cores, an application specific integrated circuit (ASIC), field programmable gate array (FPGA) or other hardware structure to perform the functions disclosed herein. The executable code may, when executed by the processor 131, cause the processor 131 to implement at least the functionality of controls various functions of the microfluidic mixing device 120, such as disclosed herein. In the course of executing code, the processor 131 may receive input from and provide output to a number of the remaining hardware components, directly or indirectly.

The processor may also interface with a number of main channel flow rate sensors (not shown), such as integrated flow meters or external flow meters, including optical flow meters, to determine, or may otherwise measure, calculate, or estimate, the velocity of fluid flowing in the main channel. For example, the processor may calculate or estimate the velocity of fluid flowing through the main channel based on known factors including the activation status of the external pump 111, the flow known to be produced by the external pump 111, the resistance to flow provided by the fluid inlet chamber 112, the fluid outlet chamber 126, and the main channel 121, the viscosity or viscosities of the fluid or fluids flowing through the main channel 121, the activation state of secondary-channel inertial pumps 125, and the positive or negative contribution of secondary-channel inertial pumps 125 to main channel flow, among other factors.

The data storage device 132 may store data such as executable program code that is executed by the processor 131 or other processing device. As will be discussed, the data storage device 132 may specifically store a number of applications that the processor 131 executes to implement at least the functionality described herein. The data storage device 132 may include various types of memory modules, including volatile and nonvolatile memory. For example, the data storage device 132 of the present example includes Random Access Memory (RAM) 133, Read Only Memory (ROM) 134, flash solid state drive (SSD), and Hard Disk Drive (HDD) memory 135. Many other types of memory may also be utilized, and the present specification contemplates the use of many varying type(s) of memory in the data storage device 132 as may suit a particular application of the principles described herein. In certain examples, different types of memory in the data storage device 132 may be used for different data storage needs. For example, in certain examples the processor 131 may boot from Read Only Memory (ROM) 134, maintain nonvolatile storage in the Hard Disk Drive (HDD) memory 135, and execute program code stored in Random Access Memory (RAM) 133.

In this manner, the control device 136 includes a programmable device that includes machine-readable or machine usable instructions stored in the data storage device 132, and executable on the processor 131 to control mixing and pumping processes on the microfluidic mixing device 120. The "machine" herein may refer to any of the processors and/or control devices described herein. Such modules may include, for example, a pump actuator module 136 to implement sequence and timing instructions.

In one example, the control device 130 may receive data from a host device 140, such as a computer, and temporarily store the data in the data storage device 132. The data from the host 140 represents, for example, executable instructions and parameters for use alone or in conjunction with other executable instructions in other modules stored in the data storage device 132 of the control device 130 to control fluid flow, fluid mixing, and other fluid mixing related functions within the microfluidic mixing device 120. For example, the instructions executable by processor 131 of the control device 130 may enable selective and controlled activation of a number of micro-inertial pumps or actuators (FIG. 1, 123, 125) within the microfluidic mixing device 120 through precise control of the sequence, timing, frequency and duration of fluid displacements generated by the inertial pumps (FIG. 1, 123, 125). For instance, modifiable (e.g., programmable) parameters thus can be set and dynamically adjusted to control the inertial pumps (FIG. 1, 123, 125) and pump sequence and timing instructions enables any number of different mixing process protocols to be performed on different implementations of the microfluidic mixing device 120 within the microfluidic mixing system 100. In one example, mixing protocols may be adjusted on-the-fly for a given microfluidic mixing device 120.

The microfluidic mixing system 100 may also include a number of power supplies 102 to provide power to the microfluidic mixing device 120, the control device 130, the external fluidic reservoirs 110, the external pump 111, and other electrical components that may be part of the microfluidic mixing system 100.

Figure 2A:
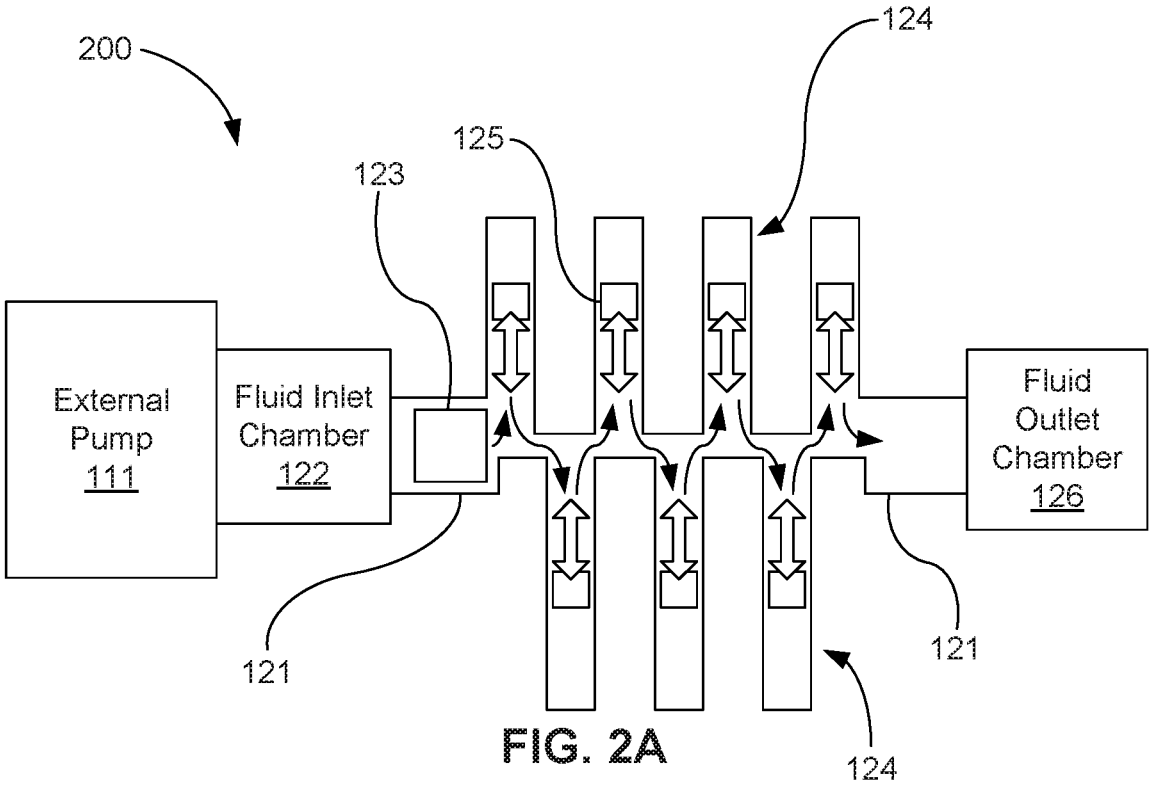
FIG. 2A is a cross-sectional diagram of an example of a microfluidic mixing device to generate a sinusoidal or serpentine flow.
Figure 2B:
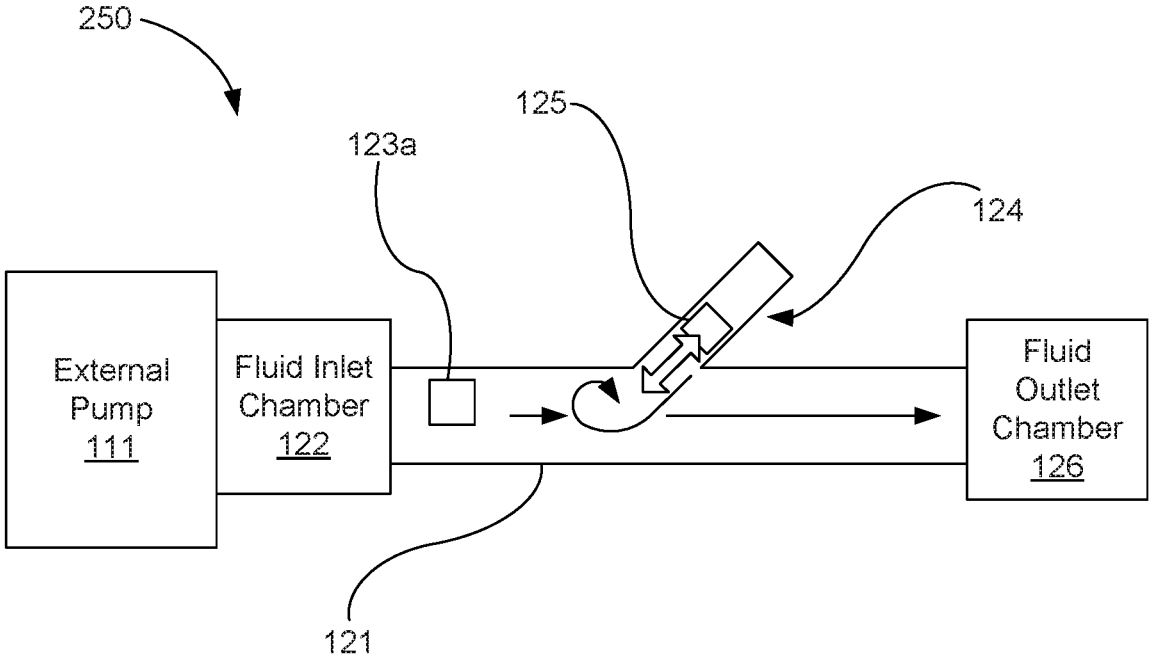
FIG. 2B is a cross-sectional diagram of an example of a microfluidic mixing device to generate a vorticity-inducing counterflow.

FIG. 2A is a cross-sectional diagram of a microfluidic mixing device 200 that generates a sinusoidal or serpentine flow, according to one example of the principles described herein. FIG. 2B is a cross-sectional diagram of a microfluidic mixing device 250 that generates a vorticity-inducing counterflow according to another example of the principles described herein. When referring to elements or characteristics of a microfluidic mixing device that may be present in various examples described herein, reference to the microfluidic mixing device 120 of FIG. 1 will be made. However, any elements that may be described in connection with any example of a microfluidic mixing device may also be applied to other examples of microfluidic mixing devices.

Throughout FIGS. 2A, 2B, and 3A-3R arrows indicating direction of flow are depicted. In some examples, arrows indicating the flow of fluids through the microfluidic mixing device (FIG. 1, 120) may be depicted as being relatively larger or smaller than other arrows. The larger arrows indicate a greater force or pressure exerted by the external pump 111 or secondary-channel inertial pumps 125 as the case may be. These differences in forces or pressures exerted cause the fluids within the microfluidic mixing device (FIG. 1, 120) to flow differently. Further, although the flow of fluids through the main channel (FIG. 1, 121) may or may not be described with respect to a given figure, all microfluidic mixing devices (FIG. 1, 120) described herein include a flow within the main channel (FIG. 1, 121) that interacts with flows present in a number of secondary channels (FIG. 1, 124). The flows within the main channel (FIG. 1, 121) are transverse to a number of flows created by the secondary channels (FIG. 1, 124), and, in this manner, the fluids introduced into the microfluidic mixing devices (FIG. 1, 120) are amalgamated.

The example microfluidic mixing devices (200, 250) of FIGS. 2A and 2B may include an external pump 111. In examples of microfluidic mixing systems (FIG. 1, 100) or microfluidic mixing devices 120 disclosed herein where an external pump 111 is used, the external pump 111 fluidly couples the external fluid reservoirs (FIG. 1, 110) with the main channels 121 of the microfluidic mixing devices (FIG. 1, 120) to supply the fluid to the microfluidic mixing devices 120 for mixing. In other examples, the microfluidic mixing devices (FIG. 1, 120) may not include an external pump 111.

The example microfluidic mixing devices (200, 250) of FIGS. 2A and 2B include a main channel 121 fluidly coupled to the external pump 111. The main channel 121 assists in the mixing of the fluids that are introduced into the microfluidic mixing devices (200, 250) by providing a pathway in which the fluids can mix as they flow through the main channel 121. In one example, the shape of main channel 121 may include other shapes such as curved shapes, snake-like shapes, shapes with 90 degree corners, shapes with corners having acute angles, shapes with corners having obtuse angles, among other shapes, and combinations thereof. The shape of the main channel 121 may depend on the process by which the microfluidic mixing devices (FIG. 1, 120) are made, and the application for which the microfluidic mixing devices (FIG. 1, 120) are used, among other parameters.

Fluids entering the main channel 121 pass into the main channel 121 from a fluid inlet chamber 122. Any number of separate portions of fluids may be introduced into the main channel 121 through fluid inlet chamber 122 for mixing. In one example, two separate portions of fluids may be introduced into the main channel 121. In another example, more than two separate portions of fluids may be introduced into the main channel 121. In another example, a single host fluid may be introduced into the main channel 121 in which the host fluid includes pigments, particles, or combinations thereof that are to be mixed within the single host fluid by the microfluidic mixing device (FIG. 1, 120).

A number of main-channel inertial pumps 123 may be positioned within the main channel 121. In one example, the main-channel inertial pumps 123 may be axis-asymmetric inertial pumps; main-channel inertial pumps 123 integrated within the main channel 121 at a location that is on one side or the other of the center line, or central axis, that runs the length of the main channel 121. In another example, the main-channel inertial pumps 123 may be axis-symmetric inertial pumps; main-channel inertial pumps 123 integrated within the main channel 121 at a location that is substantially on the central axis that runs the length of the main channel 121. In still another example, the main-channel inertial pumps 123 may include a combination of axis-asymmetric and axis-symmetric inertial pumps. The main-channel inertial pumps 123 may be located anywhere along the length of the main channel 121.

The main-channel inertial pumps 123 are any device that, when instructed by the control device 130, create a number of displacements and transverse flows within the main channel 121 of the microfluidic mixing device 120 that cause amalgamation to occur between the fluids. These displacements or transverse flows mix the fluids introduced into the microfluidic mixing device 120 to create a mixture with a desired level of homogeneity and heterogeneity.

The main-channel inertial pumps 123 may be any of a number of types of fluidic inertial pump actuators. In one example, the main-channel inertial pumps 123 may be implemented as thermal resistors that produce steam bubbles to create fluid displacement within the main channel 121. In another example, the main-channel inertial pumps 123 may also be implemented as piezo elements, such as, for example, lead zirconium titanate-based (PZT) elements whose electrically induced deflections generate fluid displacements within the main channel 121. Other deflective membrane elements activated by electrical, magnetic, mechanical, and/or other forces may also be used in implementing the functionality of the main-channel inertial pumps 123.

In another example, the main-channel inertial pumps 123 may be active mixing devices that provide forces that speed up the amalgamation process between the fluids introduced into the microfluidic mixing device (FIG. 1, 120) to be mixed. The active mixing devices may employ a mechanical transducer that agitates the fluid components to improve mixing. Examples of transducers used in active mixers include acoustic or ultrasonic, dielectrophoretic, electrokinetic timepulse, pressure perturbation, and magnetic transducers.

The example microfluidic mixing devices (200, 250) of FIGS. 2A and 2B may include a number of secondary channels 124 through which the number of fluids introduced into the main channel 121 may flow in order to assist in the mixing of the fluids within the microfluidic mixing devices (200, 250). Although seven secondary channels 124 are depicted in FIG. 2A and one secondary channel is depicted in FIG. 2B, any number of secondary channels 124 may be integrated into the microfluidic mixing devices (FIG. 1, 120) described herein. The secondary channels may extend along a straight (e.g., "I-shaped") path, and may be, for example, have a length that is a multiple of its diameter (e.g., at least about 2.5 secondary-channel-diameters long) to facilitate mixing.

The I-shaped secondary channels 124 each provide respective path in which volumes of the fluids introduced into the main channel 121 may be drawn from the main channel 121, and reintroduced into the main channel 121. Movement of the fluids through the secondary channels 124 provides for additional instances in which the fluids experience a number of transverse flows within the main channel 121 of the microfluidic mixing device (FIG. 1, 120) and displacement with respect to other fluids. In this manner, the number of fluids introduced into the microfluidic mixing device (FIG. 1, 120) are mixed and amalgamated.

A number of secondary-channel inertial pumps 125 may be positioned within the secondary channels 124 to move fluids from the main channel 121, through the secondary channels 124, back into the main channel 121, and combinations of these fluid movements. In one example, the secondary-channel inertial pumps 125 may be axis-asymmetric inertial pumps; secondary-channel inertial pumps 125 integrated within the secondary channels 124 at a location that is on one side or the other of a central axis that runs the length of the secondary channel 124. In another example, the secondary-channel inertial pumps 125 may be axis-symmetric inertial pumps; secondary-channel inertial pumps 125 integrated within the secondary channel 124 at a location that is substantially on the central axis that runs the length of the secondary channels 124. In still another example, the secondary-channel inertial pumps 125 may be a combination of axis-asymmetric and axis-symmetric inertial pumps. The secondary-channel inertial pumps 125 may be located anywhere along the length of the secondary channels 124.

The secondary-channel inertial pumps 125 are any device that, when instructed by the control device 130, moves the fluid through the secondary channels 124. The secondary-channel inertial pumps 125 may also be instructed to create a number of transverse flows within the secondary channels 124 of the microfluidic mixing devices 120. These displacements or transverse flows mix the fluids introduced into the microfluidic mixing device 120 to create a mixture with a desired level of homogeneity and heterogeneity. In one example, the secondary-channel inertial pumps 125 may be any of a number of types of fluidic inertial pump inertial pumps. In one example, the secondary-channel inertial pumps 125 may be implemented as thermal resistors that produce vapor bubbles to create fluid displacement within the secondary channels 124. In another example, the secondary-channel inertial pumps 125 may also be implemented as piezo elements, such as, for example, lead zirconium titanate-based (PZT) elements whose electrically induced deflections generate fluid displacements within the secondary channels 124. Other deflective membrane elements activated by electrical, magnetic, mechanical, and other forces may also be used in implementing the functionality of the secondary-channel inertial pumps 125.

In another example, the secondary-channel inertial pumps 125 may perform active mixing by providing forces that speed up the amalgamation process between the fluids introduced into the microfluidic mixing device (FIG. 1, 120) to be mixed. The active mixing devices may employ a mechanical transducer that agitates the fluid components to improve mixing. Examples of transducers used in active mixers include acoustic or ultrasonic, dielectrophoretic, electrokinetic timepulse, pressure perturbation, electrochemical bubble generators, and magnetic transducers.

The example microfluidic mixing devices (200, 250) of FIGS. 2A and 2B may include a fluid outlet chamber 126 into which the fluids, in a mixed state, are received as the fluids exit the main channel 121 of the microfluidic mixing device 200. In one example, the fluid outlet chamber 126 is implemented in a number of ways, such as, for example, a reservoir, as another fluidic channel, and as a reservoir with a number of coupled fluidic channels, among others.

The microfluidic mixing device 200 of FIG. 2A uses the secondary-channel inertial pumps 125 to cause the fluids to move from the main channel 121, into the secondary channel 124, and back into the main channel 121 in the same direction as the direction of flow within the main channel 121. As such, the I-shaped secondary channels 124 produce a flood and drain flow into and out of the I-shaped secondary channels 124. The secondary-channel inertial pumps 125 are controlled by their sequence of actuation to work fluid flow in the main channel 121 in an undulating fashion, as indicated by the arrows, that promotes more effective mixing.

In contrast, the microfluidic mixing device 250 of FIG. 2B is a counterflow microfluidic mixing device including an I-shaped secondary channel 124 that is obliquely oriented with respect to the main channel 121, in contrast to the perpendicularly oriented secondary channels 121 in the device of FIG. 2A. In the example of FIG. 2B, actuation of a secondary-channel inertial pump 125 in the obliquely oriented I-shaped secondary channel 124 produces a flood and drain flow into and out of the I-shaped secondary channel 124, but because of the oblique orientation of the secondary channel 124 at an obtuse angle with respect to the direction of flow in the main channel 121 axially therethrough, a vorticity-inducing counterflow is generated in the main channel 121, as indicated by the flow direction arrows. Resultant vortices promote effective mixing of fluids flowing through the main channel 121. In other examples, the oblique orientation of the I-shaped secondary channel 124 may be at an acute angle with respect to the direction of flow in the main channel 121. In the illustrated example, the I-shaped secondary channel 124 is angled at 135° with respect to the main channel 121. In other examples, the I-shaped secondary channel 124 may be angled at 45° with respect to the direction of flow in the main channel 121.

FIG. 2B also illustrates that the main-channel inertial pump (123*a*) is asymmetrically located within the main channel 121 to create main fluidic channel flow. Axis-asymmetric main-channel inertial pumps 123 integrated within the main channel 121 at a location that is on one side or the other of the center line, or central axis, that runs the length of the main channel 121, may be used, by themselves or in combination with other axis-asymmetric or axis-symmetric main-channel inertial pumps, in any of the examples described herein.

In the examples of FIGS. 2A and 2B, and throughout the examples described herein, any number of secondary-channel inertial pumps 125 may be located within the secondary channels 124. The location of the secondary-channel inertial pumps 125 may vary based on, for example, the number and implementation of the secondary-channel inertial pumps 125 within the secondary channels.

The main-channel inertial pumps (123, 123*a*) and secondary-channel inertial pumps 125 in the examples of FIGS. 2A and 2B, and throughout the examples described herein, are actuated by the control device 130 via an electrical connection (FIG. 1, 150). As described above, the control device 130 controls various components and functions of the system 100. This includes various functions of the microfluidic mixing device 120 including the sequence and timing of activation for inertial pumps within the mixing device 120 to mix fluid within the mixing device 120 and to move fluid through the mixing device 120. In this manner, various fluid flows may be moved through the main channel 121 and the secondary channels 124 such that the fluids mix. A number of various configurations and arrangements of elements within a microfluidic mixing device will now be described in connection with FIGS. 3A through 3R.

Figure 3A:
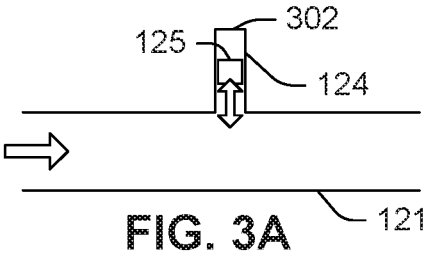
FIG. 3A is a cross-sectional diagram of an example of a microfluidic mixing device including a number of secondary-channel inertial pumps to produce a flood and drain flow through the microfluidic mixing device.

FIG. 3A is a cross-sectional diagram of a microfluidic mixing device in which a number of secondary-channel inertial pumps produce a flood and drain flow through the microfluidic mixing device, according to one example of the principles described herein. In the example of FIG. 3A, the fluids are drawn into the I-shaped secondary channel 124 via the inertial pump 125, allowed to flood the I-shaped channel 124 by flowing to a terminal point 302, and drain back into the main channel 121. In one example, the inertial pump 125 may be a bi-directional inertial pump that assists in the flow of fluids in both directions. In this example, the inertial pump 125 may alternate between actuations that cause the fluids to ebb and flow in and out of the I-shaped channel 124. In this manner, the fluids drawn into the I-shaped channel 124 create a number of transverse flows within the main channel 121, and cause the fluids to mix.

Figure 3B:
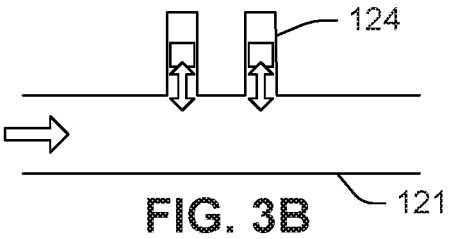
FIG. 3B is a cross-sectional diagram of an example of a microfluidic mixing device including I-shaped secondary channels fluidly coupled to a main channel.
Figure 3C:
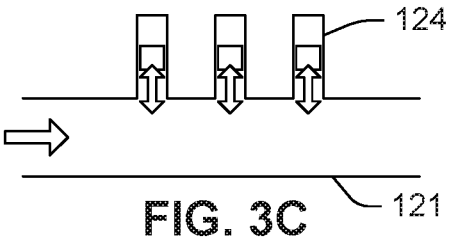
FIG. 3C is a cross-sectional diagram of another example of a microfluidic mixing device including I-shaped secondary channels fluidly coupled to a main channel.

Any number of I-shaped channels 124 may be fluidly coupled to the main channel 121 to provide fluid communication between the main channel and the I-shaped channels. The number of I-shaped channels 124 may be located along the main channel 121 in any arrangement or configuration. Thus, in the example illustrated in FIG. 3B, two I-shaped secondary channels 124 are fluidly coupled to the main channel 121, both on a single side of the main channel. In the example illustrated in FIG. 3C, three I-shaped secondary channels 124 are fluidly coupled to the main channel 121, all on a single side of the main channel. In the example illustrated in FIG. 3D, four I-shaped secondary channels 124 are fluidly coupled to the main channel 121, all on a single side of the main channel. The secondary channels and associated inertial pumps may be identical to each other or different from each other. That is, the secondary channels may vary in length and width, and their respective inertial pump may vary in size, location, and actuator type.

The microfluidic mixing device 120 achieves a mixing effect in the fluids passing through the main channel 121 by controlling a number of inertial pumps (FIG. 1, 123, 125). In one example, the inertial pumps (FIG. 1, 123, 125) may be activated in an alternating sequence of activation. In this example, as fluids pass over the inertial pumps (FIG. 1, 123, 125), the alternating activation of the inertial pumps (FIG. 1, 123, 125) displaces fluids to create a wiggling fluid flow path. The wiggling fluid flow path causes the fluids to mix with a mixing efficiency that exceeds that of mixing by diffusion.

Figure 3D:
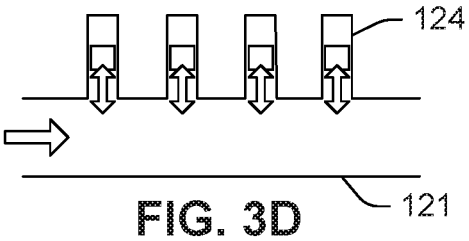
FIG. 3D is a cross-sectional diagram of still another example of a microfluidic mixing device including I-shaped secondary channels fluidly coupled to a main channel.
Figure 3E:
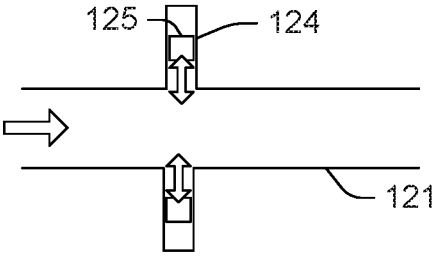
FIG. 3E is a cross-sectional diagram of an example of a microfluidic mixing device including secondary-channel inertial pumps in secondary channels.
Figure 3F:
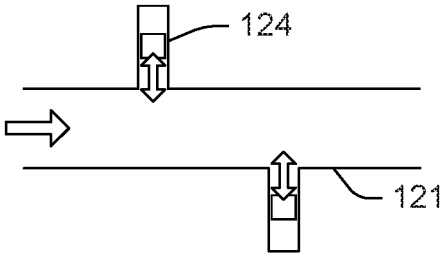
FIG. 3F is a cross-sectional diagram of another example of a microfluidic mixing device including secondary-channel inertial pumps in secondary channels.
Figure 3G:
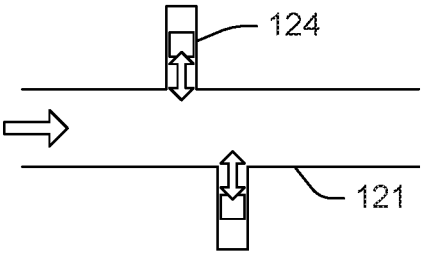
FIG. 3G is a cross-sectional diagram of still another example of a microfluidic mixing device including secondary-channel inertial pumps in secondary channels.
Figure 3H:
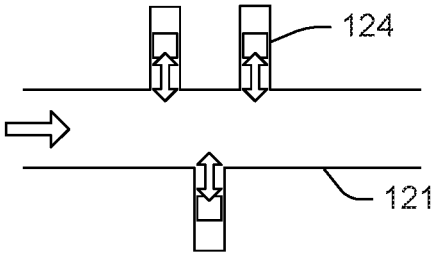
FIG. 3H is a cross-sectional diagram of yet another example of a microfluidic mixing device including secondary-channel inertial pumps in secondary channels.
Figure 3J:
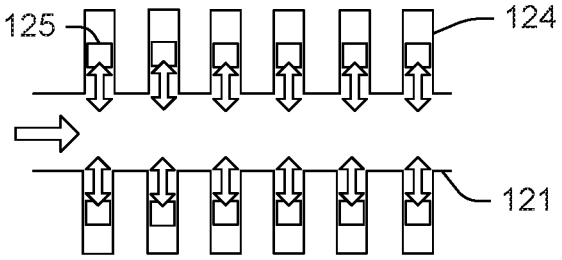
FIG. 3J is a cross-sectional diagram of another example of a microfluidic mixing device including secondary-channel inertial pumps in secondary channels.
Figure 3K:
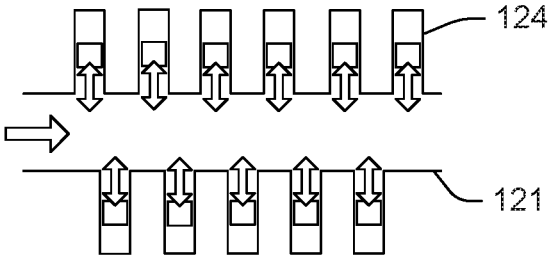
FIG. 3K is a cross-sectional diagram of still another example of a microfluidic mixing device including secondary-channel inertial pumps secondary channels.
Figure 3L:
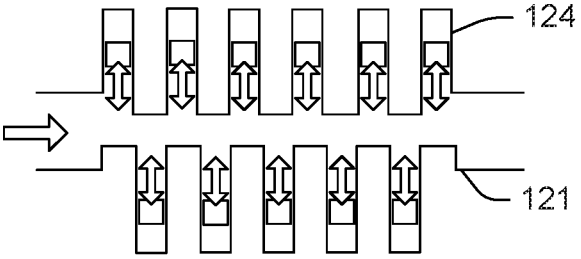
FIG. 3L is a cross-sectional diagram of another example of a microfluidic mixing device including secondary-channel inertial in a plurality of secondary channels.
Figure 3M:
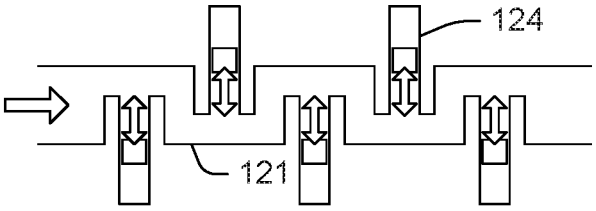
FIG. 3M is a cross-sectional diagram of another example of a microfluidic mixing device including secondary-channel inertial pumps in a plurality of secondary channels.
Figure 3N:
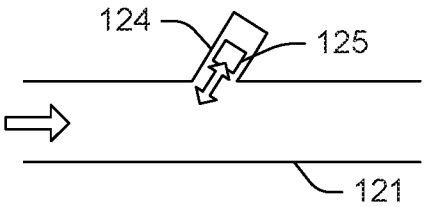
FIG. 3N is a cross-sectional diagram of an example of a microfluidic mixing device including an I-shaped secondary channel containing an inertial pump.
Figure 3P:
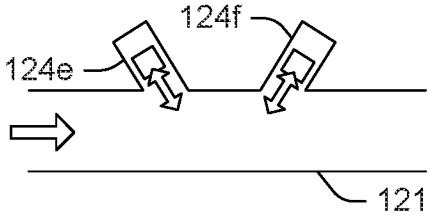
FIG. 3P is a cross-sectional diagram of an example of a microfluidic mixing device including I-shaped secondary channels containing inertial pumps.
Figure 3Q:
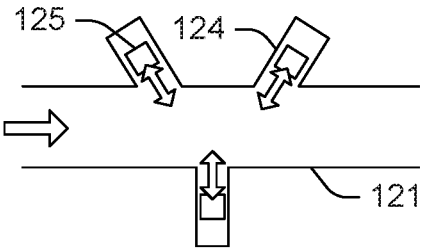
FIG. 3Q is a cross-sectional diagram of another example of a microfluidic mixing device including I-shaped secondary channels containing inertial pumps.
Figure 3R:
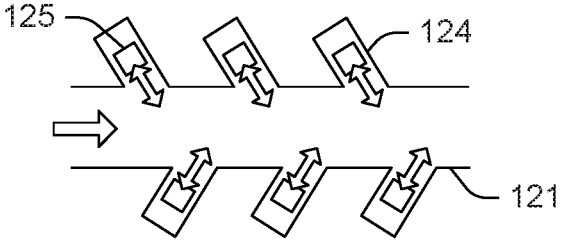
FIG. 3R is a cross-sectional diagram of an example of a microfluidic mixing device including obliquely oriented secondary channels.

For each of the numerous possible inertial pump (FIG. 1, 123, 125) configurations, of which examples are shown in FIGS. 3A through 3R, a number of alternating activation sequences or mixing protocols that may be applied. The alternating sequences of activation may or may not include a time delay between different successive activations. For example, referring to FIG. 2A, the main channel 121 includes a single main-channel inertial pump 123. In this example, an alternating sequence of activation can include an activation of the inertial pump 123, followed by a time delay, and followed by another activation of the inertial pump 123. This time-delayed actuation may be performed any number of iterations. The activation of an inertial pump 123 may last for a predetermined time duration that may be adjusted and programmably controlled by the control device 130.

In another example, two or more inertial pumps 123 may be located within the main channel 121. In this example, an alternating sequence of activation may include an activation of a first inertial pump 123 which lasts for a first time duration, followed by an activation of the second inertial pump 123 which lasts for a second time duration, followed thereafter by another activation of the first inertial pump 123. This actuation series may be performed any number of iterations. In one example, the activation of the two inertial pumps 123 alternates such that the two inertial pumps 123 are not activated simultaneously. During the activation time of the first inertial pump 123, the second inertial pump 123 is idle. The second inertial pump 123 is then activated directly after the completion of the activation time of the first inertial pump 123, with no time delay between when the first inertial pump 123 activation ends, and when the second inertial pump 123 activation begins. Therefore, in such an alternating sequence of activation, there is no time delay between successive activations of the two 123. In other examples, a time delay can be imposed between successive activations of the inertial pumps 123.

In another example, a different alternating sequence of activation can also include an activation of a first inertial pump 123 for a predetermined time duration, followed by a time delay, followed by an activation of the second inertial pump 123 for a preset time duration, followed by a time delay, followed by another activation of the first inertial pump 123. This time delayed actuation may be performed any number of iterations. The two inertial pumps 123 are activated in turn; one after the other in a non-simultaneous manner, and a time delay is inserted in between the end of one activation and the beginning of a next activation. Therefore, in such a different alternating sequence of activation, there are time delays between successive activations of the inertial pumps 123.

The above examples are examples of the activation of a number of main-channel inertial pumps 123. The same examples described in connection with the actuation of the main-channel inertial pumps 123 may also be applied to a number of secondary-channel inertial pumps 125. Thus, for example, inertial pumps 125 in all four of the I-shaped secondary channels 124 illustrated in FIG. 3D may be controlled by control device 130 to be activated simultaneously, or alternating inertial pumps 125 may be activated simultaneously and with some time delay from the activation of the other set of alternating pumps to produce a dual pumping action, or the secondary-channel inertial pumps 125 may be activated in spatial sequence, one after another and close enough in time, so as to create a wavelike pattern of secondary-channel inertial pump actuation that imparts directional motion to fluid flowing in the main channel 121. The described actuation secondary inertial pump actuation schemes can be used not only to promote mixing of fluid in the main channel 121 but also to enhance transport of fluid in the main channel 121 in the intended direction of main channel flow. That is to say, the secondary channel pumps 125 may supplement the pumping action of any main channel pump, whether external 111 or internal 123.

Figure 4A:
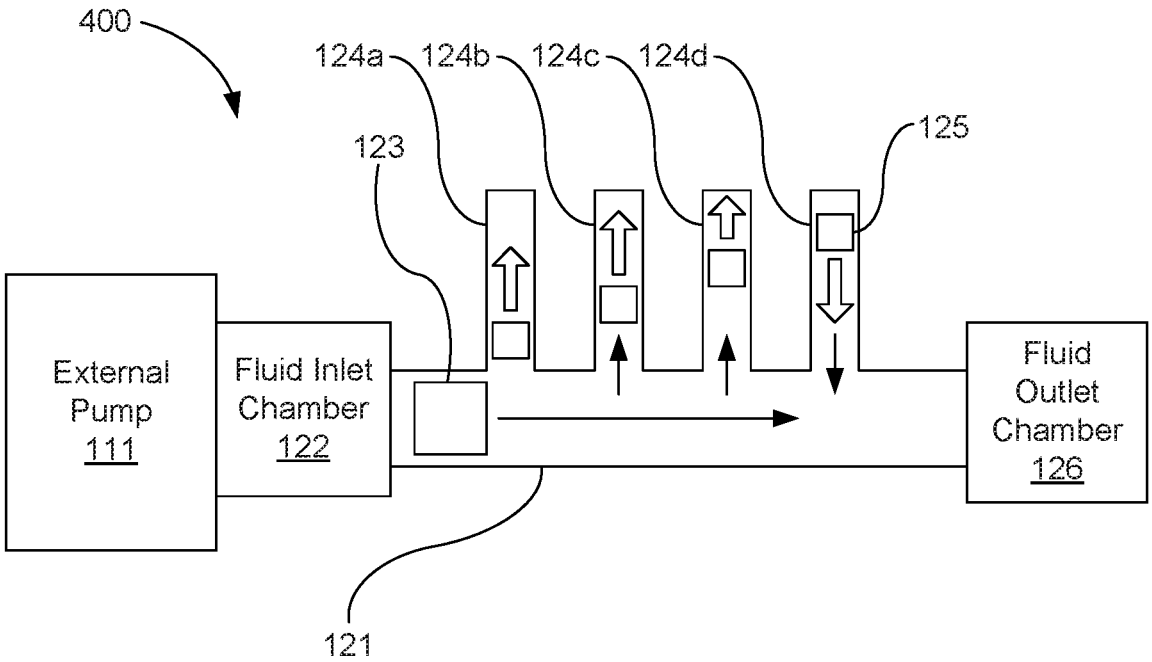
FIGS. 4A and 4B depict cross-sectional diagrams of an example of a microfluidic mixing device demonstrating an example of a sequenced actuation of secondary-channel inertial pumps.
Figure 4B:
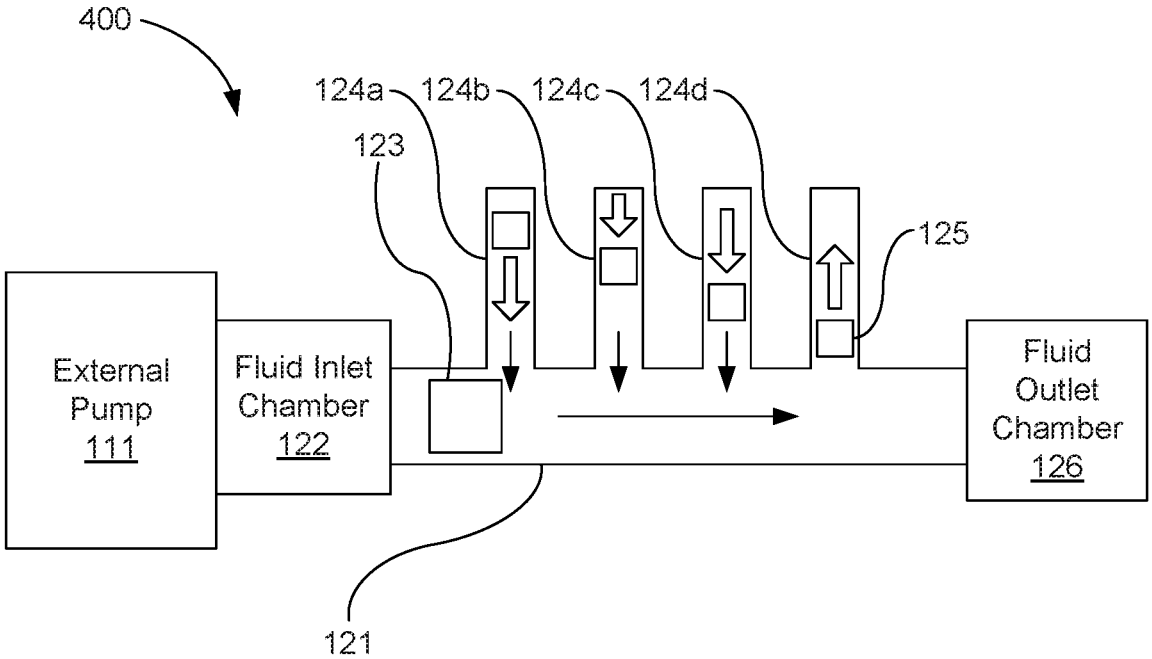

FIGS. 4A and 4B illustrate the sequenced actuation of secondary-channel inertial pumps 124 in order of their spatial arrangement so as to create a wavelike pattern of secondary-channel inertial pump actuation that imparts directional motion to fluid flowing in the main channel 121, as described above. FIGS. 4A and 4B show, at different points in time in the actuation of secondary-channel inertial pumps 125, cross-sectional diagrams of a microfluidic mixing device 400 in which the secondary-channel inertial pumps 125 produce a flood and drain flow through the microfluidic mixing device. The mixing device 400 is arranged with four secondary channels 124, all extending outwardly from the same side of the main channel 121 as illustrated in FIG. 3D.

In FIGS. 4A and 4B, the actuation of the secondary-channel inertial pumps 125 is controlled by control device 130 with such frequency and timing that the secondary-channel inertial pumps 125 collectively operate in a wavelike pattern. The secondary-channel inertial pumps can be activated at the same frequency but shifted slightly in phase from one to the next in the sequence. Thus, at one point in time, as in FIG. 4A, those secondary-channel inertial pumps 125 nearer to the main channel 121 (i.e., those in secondary channels labeled 124*a*, 124*b*, and 124*c*) are actuating to draw fluid away from the main channel while an inertial pump 125 that has reached the extent of its actuation (i.e., the one in secondary channel labeled 124*d*) is actuated to move fluid back toward the main channel 121. At a later point in time, as in FIG. 4B, when the latter inertial pump 125 has reached the opposite extent of its actuation, at the end of its respective secondary channel 124 proximal to the main channel 121, it is actuated to move fluid away from the main channel toward the distal end of its respective secondary channel 124, while the other inertial pumps 125 (i.e., those in secondary channels 124*s*, 124*b*, and 124*c*) are being actuated to move fluid back toward the main channel 121. The respective directions of actuation of the secondary-channel inertial pumps 125 are as indicated by the larger arrows. This actuation pattern not only results in enhanced mixing of fluid in the main channel 121 but also transports of fluid through the main channel 121 more effectively than what would be accomplished by external pump 111 and/or main-channel inertial pump 123, consistent with the overall goal of mixing device (100, 400) not only to mix fluids but to sustain flow pressure, and thus flow rate, through the main channel 121.

Further, in another example, the actuation of the main-channel inertial pumps 123 with respect to the actuation of the secondary-channel inertial pumps 125 and the timing and time delays between actuation associated therewith may follow the examples described above in connection with the activation sequences and mixing protocols of the main-channel inertial pumps 123.

Throughout the examples described herein, the secondary channels 124 and their associated secondary-channel inertial pumps 125 produce flow of fluids that assist in the mixing of the fluids within the main channel 121. In one example, the flow rate of fluids within the main channel 121 may be slower relative to the flow rate of the fluids within the secondary channels 124. This may be achieved by tuning a number of parameters. These tunable parameters include, for example, maintaining a slower activation rate (Hz) of the main-channel inertial pumps 123 with respect to the secondary-channel inertial pumps 125; increasing the area and width of the secondary channels 124; adjusting firing rates of the inertial pumps (123, 125); controlling the external pump (FIG. 1, 111) and the force or pressure it produces; adjusting the sizes of the inertial pumps (123, 125); increasing the number of secondary-channel inertial pumps 123; or combinations thereof.

Figure 5A:
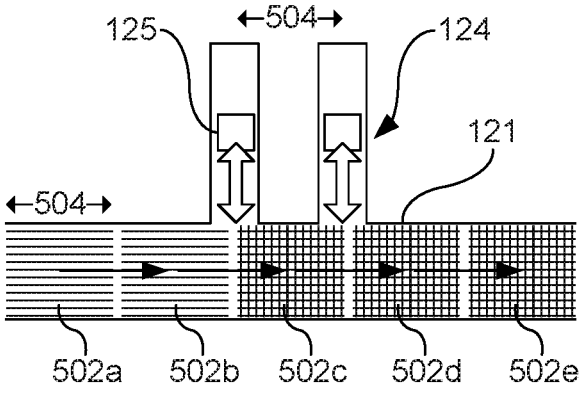
FIGS. 5A and 5B depict cross-sectional diagrams of an example of a microfluidic mixing device demonstrating volumes of unmixed and mixed fluid flowing through a main channel thereof.
Figure 5B:
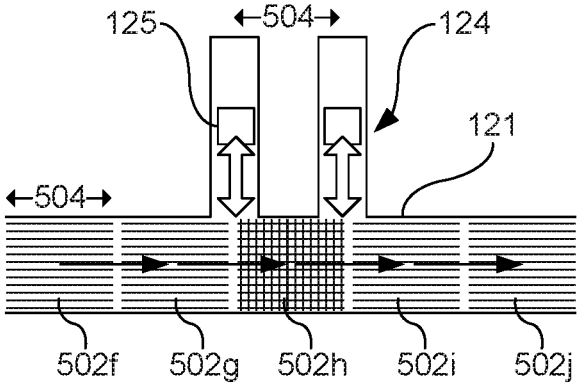

For the purposes of illustration, and with reference to FIGS. 5A-5B, main flow may be thought of as consisting of a series of discretized volumes (also referred to as "chunks") of fluid (502*a*-502*e*) flowing through the main channel 121 in the indicated direction of flow. For the simple case of a straight main channel of constant cross-sectional area, the flow rate of fluid through the main channel is equal to the velocity of fluid flowing through the main channel 121 times the cross-sectional area of the main channel 121. The main-channel flow rate and the activation rates of the secondary-channel inertial pumps 125 can be coordinated so that chunks of fluid (502*a*-502*e*) moving through the main channel experience fluid mixing by the secondary channels, and thus do not pass unmixed.

In FIG. 5A, main channel flow is below the above-described critical velocity, resulting in unmixed volumes, or chunks, of main channel flow (502*a*, 502*b*) all being mixed (502*c*, 502*d*, 502*e*) by the action of the secondary-channel inertial pumps 125 as they pass through the main channel 121. By contrast, in FIG. 5B, where main channel flow is above the critical velocity, i.e., where secondary-channel inertial pump actuation frequency is less than main flow velocity divided by the distance 504 between adjacent secondary channels 124, not all volumes, or chunks, will be mixed. As shown in FIG. 5B, unmixed volumes (502*i*, 502*j*) may have flown through the main channel 121 too quickly to have been affected by the mixing action of the secondary-channel inertial pumps 125. This will be the case even if an occasional volume (502*h*) receives mixing. Such failure to achieve mixing may result at high enough main flow rates, low enough secondary-channel inertial pump actuation frequencies, low enough secondary-channel placement densities, or under a variety of other conditions.

Resultantly, in some examples, control device 130 may control external pump 111, main-channel inertial pumps 123, and/or secondary-channel inertial pumps 125 to either slow main channel flow below the above-described critical velocity defined by the distance 504 between adjacent channels 124 times secondary-channel inertial pump actuation frequency, or may increase secondary-channel inertial pump frequency to a value greater than the main flow velocity divided by the distance between adjacent secondary channels 124, or otherwise coordinate the actuation of secondary-channel inertial pumps 125 to promote mixing at high main channel flow rates. In other examples, control device 130 may control external pump 111, main-channel inertial pumps 123, and/or secondary-channel inertial pumps 125 to insure that main channel flow velocity is several times below the above-described critical velocity so that each chunk of fluid is mixed by more than one secondary-channel inertial pump 125.

For example, if the distance 504 between two adjacent secondary channels 124 is 100 microns, and inertial pumps 125 in the secondary channels are actuated at a frequency of 1 kilohertz (i.e., 1 millisecond between actuation pulses), then control device 13 can control main channel flow velocities to be less than 100 micrometers per millisecond so no chunks of fluid flowing through the main channel 121 will go unmixed by secondary-channel inertial pump action.

Thus, in some examples, the microfluidic mixing device includes a plurality of I-shaped secondary channels 124 having secondary-channel inertial pumps 125, in which at least one of the secondary-channel inertial pumps 125 is actuated at a frequency based on a measured, calculated, or estimated velocity of fluid in the main channel 121 and on an axial offset distance 504 between adjacent secondary channels 124 along the main channel 121. For example, at least one of the secondary-channel inertial pumps 125 is actuated at a frequency greater than a measured, calculated, or estimated velocity of fluid in the main channel 121 divided by an axial offset distance 504 between successive secondary channels, such that every volume of fluid longitudinally traversing the main channel 121 and extending a length 504 that is longer than the axial offset distance is mixed by the action of the at least one secondary-channel inertial pump 125.

In other examples, a microfluidic mixing system includes at least one external pump 111 and a plurality of I-shaped secondary channels 124 having secondary-channel inertial pumps 125, in which the external pump 111 is controlled based on an activation frequency of at least one secondary-channel inertial pump 125 and on an axial offset distance 504 between successive secondary channels. For example, the external pump 111 is controlled to maintain a measured, calculated, or estimated main channel flow velocity that is less than an activation frequency of at least one secondary-channel inertial pump 125 times an axial offset distance 504 between successive secondary channels 124, such that every volume of fluid longitudinally traversing the main channel 121 and extending a length 504 that is longer than the axial offset distance 504 is mixed by the action of a number of secondary-channel inertial pumps 125.

In still other examples, the microfluidic mixing device includes at least one main-channel inertial pump 123 and a plurality of I-shaped secondary channels 124 having secondary-channel inertial pumps 125, in which the main-channel inertial pump 123 is actuated based on an activation frequency of at least one secondary-channel inertial pump 125 and on an axial offset distance 504 between successive secondary channels. For example, the main-channel inertial pump 123 is actuated to maintain a measured, calculated, or estimated main channel volumetric flow velocity that is less than an activation frequency of at least one secondary-channel inertial pump 125 times an axial offset distance 504 between successive secondary channels 124, such that every volume of fluid longitudinally traversing the main channel 121 and extending a length 504 that is longer than the axial offset distance 504 is mixed by the action of a number of secondary-channel inertial pumps 125.

FIG. 3E is a cross-sectional diagram of a microfluidic mixing device in which secondary-channel inertial pumps 125 are in secondary channels 124 that are located on opposite sides of the main channel 121, without substantial axial offset from each other. For instance, the oppositely-located secondary-channels 124 can be coaxially arranged with respect to each other. As controlled by control device 130, the actuation frequencies of the respective secondary-channel inertial pumps 125 can be the same or different and can be in-phase or out-of-phase. If the oppositely-located secondary-channel inertial pumps 125 are actuated at different frequencies, the resultant beating frequency may be tuned by control device 130 to promote mixing. If the oppositely located secondary-channel inertial pumps 125 are actuated at the same frequency but 180° out of phase with each other, fluid in the main channel may be moved reciprocally, back and forth between the respective secondary channels, which may also promote mixing. If the oppositely located secondary-channel inertial pumps 125 are actuated at the same frequency and in phase with each other, i.e., if are the inertial pumps 125 are actuated simultaneously, the inertial pumps 125 together act to "crush" the main channel fluid between the secondary-channel inertial pumps 125, which may also promote mixing.

FIGS. 3F, 3G, and 3H are cross-sectional diagrams of microfluidic mixing devices in which secondary-channel inertial pumps 125 are in secondary channels 124 that are located axially offset from each other on opposite sides of the main channel 121. In the term "axially offset," the axes offset from one another are the respective longitudinal axes of the secondary channels. In the example illustrated in FIG. 3F, the axial offset distance is large enough that there is no substantial mixing-enhancing interaction between the activity of the two different secondary-channel inertial pumps 125. Thus, each secondary-channel inertial pump 125 acts upon the fluid in the main channel substantially as in the example of FIG. 3A, each one impacting mixing independently from the effects of the other. For example, large enough axial offset distances may be at least three secondary-channel widths, such six secondary-channel widths or more.

By contrast, in the example illustrated in FIG. 3G, where the axial offset distance is less than six secondary-channel widths, for example in the range of between one and three secondary-channel widths, the two secondary-channel inertial pumps 125 can act in concert to generate interactive transverse flows that induce vortices to stir fluid flowing in the main channel 121 and promote mixing.

Extending the concept of FIG. 3G, the example illustrated in FIG. 3H adds a third secondary channel 124 that is likewise axially offset from the second secondary channel 124 by less than six secondary-channel widths, for example between one and three secondary-channel widths. The three secondary-channel inertial pumps 125 can act in concert to generate interactive transverse flows that induce vortices to stir fluid flowing in the main channel 121 and promote mixing.

The examples illustrated in FIGS. 3J and 3K further extend the concepts of FIGS. 3E and 3H, respectively. FIG. 3J is a cross-sectional diagram of a microfluidic mixing device in which a plurality of secondary-channel inertial pumps 125 are in a plurality of secondary channels 124 that are located on opposite sides of the main channel 121, and where pairs of oppositely facing secondary channels 124 do not have substantial axial offset from each other. As described above with respect to the example illustrated in FIG. 3E, control device 130 can control the actuation of the respective secondary-channel inertial pumps 125 to be at different frequencies or the same frequency, out-of-phase or in-phase, to improve vorticity and mixing in the main channel 121. If the oppositely located secondary-channel inertial pumps 125 are actuated at the same frequency and in phase with each other, the opposing pairs of secondary-channel inertial pumps 125 act as "crushers" upon fluid flowing in the main channel 121 to promote mixing. As opposed to the example illustrated in FIG. 3E, however, FIG. 3J presents fluid flowing through the main channel 121 with a cascade of paired secondary channels 124 that can increase the effectiveness of mixing with each successive pair.

Extending upon the examples in FIGS. 3G and 3H, FIG. 3K is a cross-sectional diagram of a microfluidic mixing device in which a plurality of secondary-channel inertial pumps 125 are in a plurality of secondary channels 124 that are located axially offset from each other on opposite sides of the main channel 121. The axial offset distances for successive secondary channels 124 as counted moving longitudinally along the main channel 121 are less than six secondary-channel widths, for example between one and three secondary-channel widths. As described above with respect to the examples illustrated in FIGS. 3G and 3H, control device 130 can control the actuation of the respective secondary-channel inertial pumps 125 such that they act in concert to generate interactive transverse flows that induce vortices to stir fluid flowing in the main channel 121 and promote mixing. As described previously, such control can involve tuning such parameters as secondary-channel inertial pump actuation frequencies, phases, and timings, in accordance with the geometry of the main channel 121, the geometries and placements of the secondary channels 124, the main flow rate, and other parameters.

FIG. 3L, like in FIG. 2A, is a cross-sectional diagram of a microfluidic mixing device in which a plurality of secondary-channel inertial pumps 125 are in a plurality of secondary channels 124 that are located axially offset from each other on opposite sides of the main channel 121. However, in contrast to the example illustrated in FIG. 3K, the main channel 121 in the example of FIG. 3L is not of constant width, but instead has a narrower width along a portion thereof where the secondary channels reside. Thus, a largest width portion of the main channel 121 defines a largest-width boundary spaced a distance from and extending parallel to a longitudinal axis of the main channel 121. The I-shaped secondary channels 124 each have an opening into the main channel 121 that provides fluid communication with the main channel 121. The distance between each opening of the secondary channel and the longitudinal axis of the main channel 121 is less than the distance between longitudinal axis and the largest-width boundary. Stated differently, the secondary channels 124 open into the main channel 121 at points interior to the largest width of the main channel 121. The illustrated configuration works fluid flow up and down in an undulating fashion, forcing mixing through the channel 121. The I-shaped secondary channels 124 thus create serpentine flows in the direction of the main fluidic channel flow. Consequently, the example illustrated in FIG. 3L is more effective at mixing than the example illustrated in FIG. 3K, but less effective at maintaining flow rate through the main channel 121 because of the restrictiveness of its main channel 121.

Extending the principles of the example illustrated in FIG. 3L, FIG. 3M is a cross-sectional diagram of a microfluidic mixing device in which a plurality of secondary-channel inertial pumps 125 are in a plurality of secondary channels 124 that extend from the main channel 121, the secondary channels being located axially offset from each other on opposite sides of the main fluidic channel, and terminating at ends that provide openings into the main channel 121 interior to a largest width of the main channel 121. That is to say, the largest width of the main channel 121 defines a boundary spaced a distance from and extending parallel to a longitudinal axis of the main channel 121, and the openings of the I-shaped secondary channels 124 into the main channel 121 are a distance from the longitudinal axis that is less than the distance between longitudinal axis and the largest-width boundary. In contrast to the example illustrated in FIG. 3L, however, the main channel 121 in FIG. 3M is not a collinear rectangle. Instead, it snakes up and down through a series of curved paths along its length. The I-shaped secondary channels 124 create the serpentine flows in the direction of the main fluidic channel flow. Furthermore, in other examples similar to those illustrated in FIGS. 3L and 3M, the openings of the successive secondary channels 124 may be offset with respect to each other by some distances as measured from a longitudinal axis of the main channel 121.

FIG. 3N, like in FIG. 2B, is a cross-sectional diagram of a microfluidic mixing device in which an I-shaped secondary channel 124 containing an inertial pump 125 extends obliquely from a main channel 121 to create vorticity-inducing counterflow in the main channel 121. In the illustrated example, the I-shaped secondary channel 124 extends at an obtuse angle with respect to a longitudinal axis of the main channel 121 to work against main flow, but in other examples, the I-shaped secondary channel 124 may extend at an acute angle with respect to a longitudinal axis of the main channel 121 and thus may work with main flow. Because a main channel 121 may have multiple longitudinal axes inasmuch as the main channel 121 may bend, curve, or change directions at corners, and because a secondary channel 124 may be placed to open at any point along a main channel 121, as used in this specification and in the appended claims, the words "with respect to a longitudinal axis of the main channel" mean with respect to the main channel axis defined by the primary direction of flow at the portion of the main channel 121 longitudinally along the main channel 121 that is nearest the opening to the respective secondary channel. In other words, "a longitudinal axis" means the main channel longitudinal axis at or adjacent the portion of the main channel nearest the respective secondary channel openings, and not an axis of the main channel 121 at a more distant section of the main channel 121 where the main channel 121 has changed direction by curving or turning.

As opposed to the example illustrated in FIG. 3A, in which the secondary channel 124 is perpendicular with respect to a longitudinal axis of the main channel 121, construction of a secondary channel 124 to angle acutely or, as in FIG. 3N, obtusely with respect to a longitudinal axis of the main channel increases efficiency in a specific direction. Specifically, a secondary-channel inertial pump 125 pumps more effectively at the angle it is directed in. More efficient pumping of fluid, however, does not necessarily result in more effective mixing of the fluid, absent vorticity.

A plurality of obliquely angled secondary channels 124 may extend from the main channel 121, as in the example illustrated in FIG. 3P. In FIG. 3P, a microfluidic mixing device includes two I-shaped secondary channels 124 each containing an inertial pump 125 extend obliquely from a common side of main channel 121. Like the obtusely-angled secondary channel 124 in FIG. 3N, the obtusely-angled secondary channel (124*f*) in FIG. 3P creates vorticity-inducing counterflow in the main channel 121. In the example illustrated in FIG. 3P, however, inertial pump 125 in acutely angled secondary channel (124*e*) generates flows that interact with those generated by to create further turbulence and thus enhance mixing. The two secondary-channel inertial pumps 125 pump fluid back and forth in the main channel to increase effectiveness of mixing. As described above, control device 130 can control the actuation of the respective secondary-channel inertial pumps 125 such that they act in concert to generate interactive flows that induce vortices to stir fluid flowing in the main channel 121 and promote mixing. Such control can involve tuning such parameters as secondary-channel inertial pump actuation frequencies, phases, and timings, in accordance with the geometry of the main channel 121, the geometries and placements of the secondary channels 124, the main flow rate, and other parameters.

The mixing action of a number of obliquely angled secondary channels 124 extending from the main channel 121 may also be complemented by a number of perpendicularly oriented secondary channels, such as illustrated in the example of FIG. 3Q. In FIG. 3Q, secondary-channel inertial pumps 125 residing in two obliquely angled secondary channels 124, like those of FIG. 3P, work in concert with a secondary-channel inertial pump 125 in a perpendicularly oriented secondary channel 124. The pumping action of the inertial pumps 125 in the three secondary channels 124 work on a convergence point in the main channel 121. When the three secondary-channel inertial pumps 125 are activated simultaneously, i.e., all at the same frequency and in phase with each other, the inertial pumps 125 can promote a fluid "crushing" action as described above with respect to FIG. 3E. The frequencies, phases, and actuation timings of the secondary-channel inertial pumps 125 can be tuned and controlled by control device 130 to generate interactive flows that induce vortices to stir fluid flowing in the main channel 121 and promote mixing.

FIG. 3R is a cross-sectional diagram of a microfluidic mixing device having a plurality of I-shaped secondary channels 124 containing inertial pumps 125 in which each secondary channel 124 extends obliquely from a main channel 121 at acute angles with respect to a longitudinal axis of the main channel 121. The actuations of the secondary-channel inertial pumps 125 not only promote mixing but also supplement main flow, by pumping in the direction of rather than against main flow, in order to improve main flow rate and flow pressure. As with other described configurations, the frequencies, phases, and actuation timings of the secondary-channel inertial pumps 125 can be tuned and controlled by control device 130 to generate interactive flows that induce vortices to stir fluid flowing in the main channel 121 and promote mixing.

Those examples listed above as supplementing or promoting main flow rate may be employed in mixing fluids when fast flow rate is not an objective. Other examples may be employed in mixing fluids when good mixing is prioritized over fast flow rate. The control device 130 providing for a relatively greater pressure to be exerted by the external pump (FIG. 1, 111) and/or main-channel inertial pump 123 than the secondary-channel inertial pump 125 provides for a relatively lower grade of mixing among the fluids, but a high flow rate within the microfluidic mixing device 100.

Figure 6:
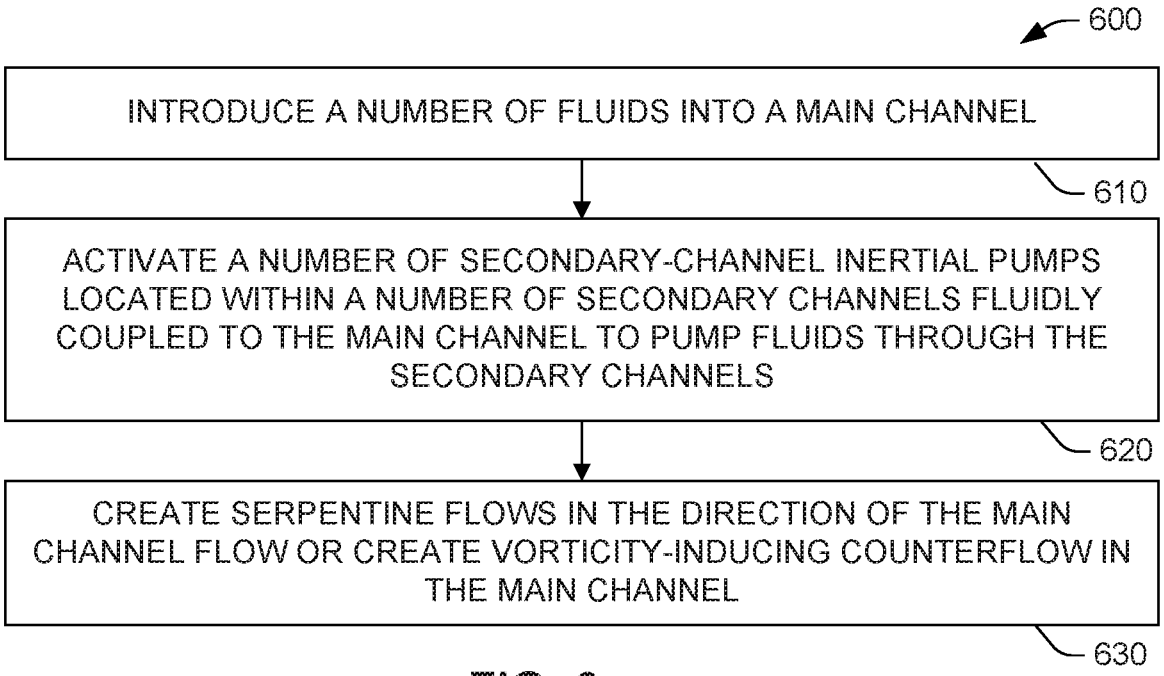
FIG. 6 is a flow diagram showing an example method of microfluidic mixing.
Figure 7:
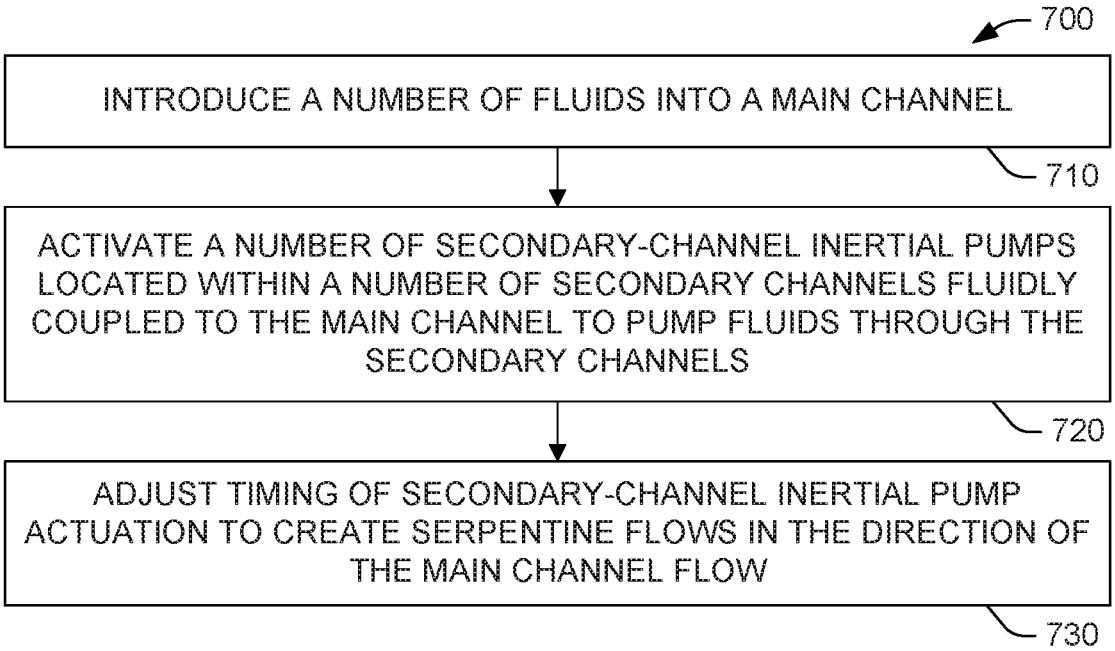
FIG. 7 is a flow diagram showing another example method of microfluidic mixing.
Figure 8:
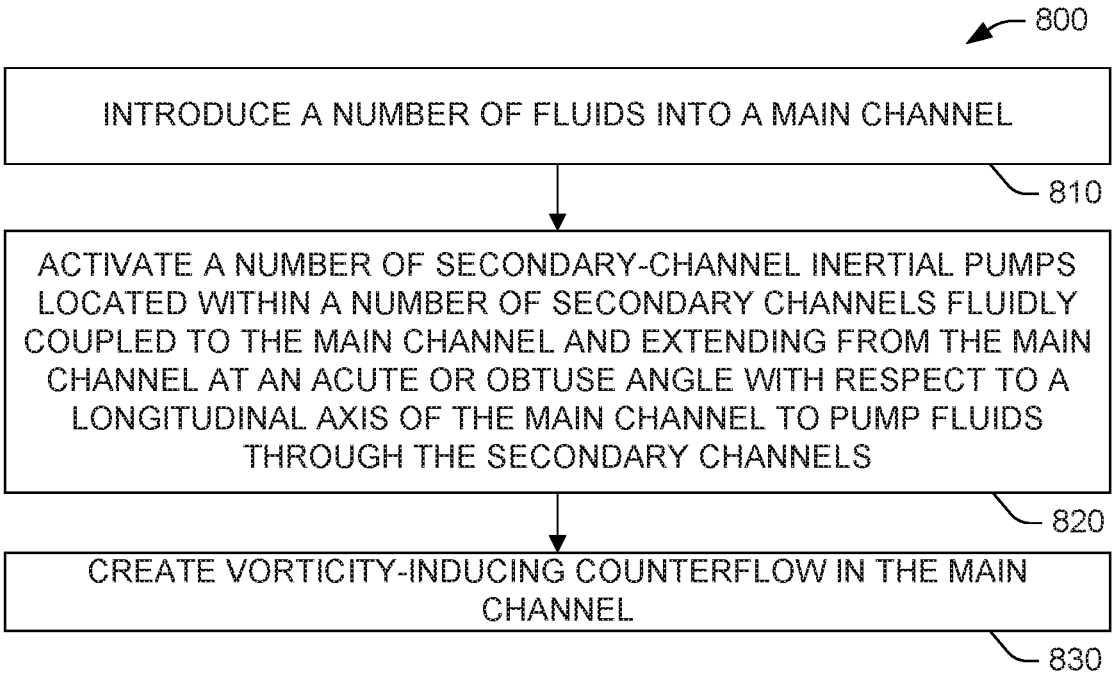
FIG. 8 is a flow diagram showing yet another example method of microfluidic mixing.

FIGS. 6-8 are flowcharts showing example methods of mixing fluids. Examples of systems and methods are described herein with reference to flowchart illustrations and/or block diagrams of methods, apparatus (systems) and computer program products according to examples of the principles described herein. Each block of the flowchart illustrations and combinations of blocks in the flowchart illustrations may be implemented by computer-usable program code. The computer-usable program code may be provided to a processor of a general purpose computer, special purpose computer, or other programmable data processing apparatus to produce a machine, such that the computer-usable program code, when executed via, for example, the processor 131 of the control device 130 or other programmable data processing apparatus, implement and/or causes the functions or acts specified in the flowchart and/or block diagram block or blocks. In one example, the computer-usable program code may be embodied within a computer-readable storage medium; the computer-readable storage medium being part of the computer program product. In one example, the computer-readable storage medium is a non-transitory computer-readable medium.

The method 600 of FIG. 6 may begin 610 by introducing a number of fluids into a main channel (FIG. 1, 121) of a microfluidic mixing device (FIG. 1, 120). A control device (FIG. 1, 130) may be used to activate the external pump (FIG. 1, 111) to draw a number of fluids from the external fluid reservoirs (FIG. 1, 110), and pump them into the microfluidic mixing device (FIG. 1, 120). The processor (FIG. 1, 131) may execute the pump actuator module (FIG. 1, 136) in order to signal the external pump (FIG. 1, 111) and external fluid reservoirs (FIG. 1, 110) via electrical connection (FIG. 1, 150). The secondary channels 124 may be I-shaped.

The method 600 may continue 620 by activating a number of secondary-channel inertial pumps (FIG. 1, 125) located within a number of secondary channels 124 fluidly coupled to the main channel 121 to pump fluids through the secondary channels 124. For instance, the control device 130 may be used to activate the inertial pumps 125 to draw a number of fluids from the main channel (FIG. 1, 121), pump the fluids through the secondary channels 124, and reintroduce the fluids back into the main channel (FIG. 1, 121). In this manner, the secondary channels 124 and their associated secondary-channel inertial pumps 125 create instances of displacement or transverse flows within the microfluidic mixing device (FIG. 1, 120). The processor (FIG. 1, 131) may execute the pump actuator module (FIG. 1, 136) in order to signal the secondary-channel inertial pumps (FIG. 1, 125) via electrical connection (FIG. 1, 150). Various timing and time delay methods may be used to achieve a desired movement of fluids through the secondary channels 124. In one example, the inertial pumps (FIG. 1, 123, 125) may be activated at a number of frequencies based on a desired flow of fluids within the microfluidic mixing device (FIG. 1, 120). For example, the inertial pumps (FIG. 1, 123, 125) may be activated at a frequency of between 1 and 20 Hz. In another example, the inertial pumps (FIG. 1, 123, 125) may be activated at a frequency of between 10 Hz and 10 kHz or at a higher frequency (e.g., about 50 kHz or more).

In one example, a number of main-channel inertial pumps (FIG. 1, 123) located within the main channel 121 in addition to the activation of the secondary-channel inertial pumps (FIG. 1, 125). In another example, the selective activation of the main-channel inertial pumps (FIG. 1, 123), the secondary-channel inertial pumps (FIG. 1, 125), or combinations thereof may be executed by the control device 130. This selective activation of the two types of inertial pumps (FIG. 1, 123, 125) provides for the ability to toggle between active mixing and pumping modes (i.e., passive mixing).

The method 600 of FIG. 6 may conclude 630 with the creation of serpentine flows in the direction of the main channel flow or the creation of vorticity-inducing counterflow in the main channel.

The above description with respect to the flowchart of FIG. 6 is applicable with respect to the flowcharts of FIGS. 7 and 8 as well. In the method 700 illustrated in FIG. 7, a number of fluids are introduced into a main channel 710 (FIG. 1, 121) of a microfluidic mixing device (FIG. 1, 120). The method 700 also includes, at 720, activating a number of secondary-channel inertial pumps (FIG. 1, 125) located within a number of secondary channels (FIG. 1, 124) fluidly coupled to the main channel (FIG. 1, 121) to pump fluids through the secondary channels (FIG. 1, 124). At 730, the timing of secondary-channel inertial pump (FIG. 1, 125) actuation is adjusted to create serpentine flows in the direction of the main channel flow. The timing adjustment 730 may be done, for example, by control device (FIG. 1, 130), such as disclosed herein.

As an example, at least two I-shaped secondary channels (FIG. 2A, 124) may extend from the main channel (FIG. 2A, 121). A first I-shaped secondary channel (FIG. 2A, 124) may be located axially offset from, and on opposite sides of the main channel (FIG. 2A, 121) from, a second I-shaped secondary channel (FIG. 2A, 124). An inertial pump (FIG. 2A, 125) within the first I-shaped secondary channel (FIG. 2A, 124) may be activated at a different time with respect to activation of an inertial pump (FIG. 2A, 125) in the second I-shaped secondary channel (FIG. 2A, 125).

In the method 800 illustrated in FIG. 8, in 810, a number of fluids are introduced into a main channel (FIG. 1, 121). In 820, a number of secondary-channel inertial pumps (FIG. 1, 125) located within a number of secondary channels (FIG. 1, 124) fluidly coupled to the main channel (FIG. 1, 121) and extending from the main channel (FIG. 1, 121) at an acute or obtuse angle with respect to a longitudinal axis of the main channel (FIG. 1, 121) are activated to pump fluids through the secondary channels (FIG. 1, 124). In 830, vorticity-inducing counterflow is created in the main channel (FIG. 1, 121).

As an example, an inertial pump (FIG. 2B, 125) within an I-shaped secondary channel (FIG. 2B, 124) extending from the main channel (FIG. 2B, 121) at an acute or obtuse angle with respect to a longitudinal axis of the main channel (FIG. 2B, 121) may be activated to create vorticity-inducing counterflow in the main channel (FIG. 2B, 121).

In view of the foregoing, the microfluidic mixing systems and methods disclosed herein provide effective mixing solutions. For example, systems and methods can be implemented to include 1 providing active, non-diffusive mixing; 2 providing a mixing efficiency greater than a 100 times per channel width compared to other mixing devices; 3 creating a small pressure drop across microfluidic mixer; 4 creating a system with a relatively shorter mixing channel; 5 providing for a small dead volume left within the mixing device after mixing; 6 providing for a microfluidic mixing device that is easy to fabricate; 7 providing a microfluidic mixing device that may be integrated with other components; 8 reduced pressure losses because of simplified geometry; and/or 9 providing for the ability to toggle between active mixing and pumping modes (passive mixing).

The preceding description has been presented to illustrate and describe examples of the principles described. This description is not intended to be exhaustive or to limit these principles to any precise form disclosed. Many modifications and variations are possible in light of the above teaching. What have been described above are examples. It is, of course, not possible to describe every conceivable combination of components or methods, but one of ordinary skill in the art will recognize that many further combinations and permutations are possible. Accordingly, the invention is intended to embrace all such alterations, modifications, and variations that fall within the scope of this application, including the appended claims. Additionally, where the disclosure or claims recite "a," "an," "a first," or "another" element, or the equivalent thereof, it should be interpreted to include one or more than one such element, neither requiring nor excluding two or more such elements. As used herein, the term "includes" means includes but not limited to, and the term "including" means including but not limited to. The term "based on" means based at least in part on.

What is claimed is:

1. A microfluidic mixing device comprising:

a main fluidic channel to provide main fluidic channel flow;

a plurality of I-shaped secondary channels extending outwardly from a portion of the main fluidic channel; and a number of secondary-channel inertial pumps located within the I-shaped secondary channels to create serpentine flows in the direction of the main fluidic channel flow or create vorticity-inducing counterflow in the main fluidic channel;

wherein at least one of the secondary-channel inertial pumps is actuated based on a velocity of fluid in the main fluidic channel and on an axial offset distance between successive secondary channels, such that a volume of fluid longitudinally traversing the main fluidic channel and extending a length that is longer than the axial offset distance is mixed by the action of the at least one secondary-channel inertial pump.

2. The microfluidic mixing device of claim 1, wherein the main fluidic channel further comprises a number of inertial pumps asymmetrically located within the main fluidic channel to create the main fluidic channel flow.

3. The microfluidic mixing device of claim 1, wherein at least two of the secondary channels extend from the main fluidic channel to define I-shaped secondary channels that are located axially offset from each other on opposite sides of the main fluidic channel, wherein a largest width portion of the main fluidic channel defines a largest-width boundary spaced a distance from and extending parallel to a longitudinal axis of the main fluidic channel, and wherein at least one of the I-shaped secondary channels has an opening that provides fluid communication with the main fluidic channel, a distance between the opening and the longitudinal axis being less than the distance between longitudinal axis and the largest-width boundary, the I-shaped secondary channels to create the serpentine flows in the direction of the main fluidic channel flow.

4. The microfluidic mixing device of claim 1, wherein a number of the secondary channels extend obliquely from the main fluidic channel at an obtuse or acute angle with respect to a longitudinal axis of the main fluidic channel to create the vorticity-inducing counterflow in the main fluidic channel.

5. The microfluidic mixing device of claim 4, wherein the number of the secondary channels include at least one obtusely angled secondary channel and at least one acutely angled second channel.

6. The microfluidic mixing device of claim 4, wherein at least two of the plurality of I-shaped secondary channels are obliquely angled in the same direction with respect to a longitudinal axis of the main fluidic channel.

7. The microfluidic mixing device of claim 4 wherein at least two of the plurality of I-shaped secondary channels are located axially offset from each other on approximately opposite sides of the main fluidic channel with respect to a longitudinal axis of the main fluidic channel.

8. The microfluidic mixing device of claim 4, wherein a number of the secondary channels extend transversely from the main fluidic channel perpendicular to the longitudinal axis of the main fluidic channel.

9. A microfluidic mixing system comprising:

a microfluidic mixing device comprising:

a main fluid mixing channel;

a number of I-shaped secondary channels extending from the main fluid mixing channel; and a number of inertial pumps located in the secondary channels to pump fluids within the secondary channels, wherein the I-shaped secondary channels produce a flood and drain flow into and out of the I-shaped secondary channels to create serpentine flows in the direction of the main fluid mixing channel flow or to create vorticity-inducing counterflow in the main fluid mixing channel;

a fluid source; and a control device to provide fluids from the fluid source to the microfluidic mixing device and activate the secondary-channel inertial pumps;

wherein at least two of the secondary channels extend from the main fluid mixing channel to define I-shaped secondary channels that are located axially offset from each other on opposite sides of the main fluid mixing channel, wherein the largest width of the main fluid mixing channel defines a boundary extending the length of the main fluid mixing channel, and wherein at least one of the I-shaped secondary channels has an opening to the main fluidic channel that originates at a position within a portion of the main fluidic channel, a distance between the opening and the largest-width boundary being less than the distance between the main fluidic channel center and the largest-width boundary, the I-shaped secondary channels to create the serpentine flows in the direction of the main fluid mixing channel flow.

10. The system of claim 9, in which the main fluid mixing channel contains a number of inertial pumps asymmetrically placed in main fluid mixing channel to create main flow.

11. The system of claim 9, wherein a number of the secondary channels extend from the main fluid mixing channel at an obtuse or acute angle with respect to a longitudinal axis of the main fluid mixing channel to create the vorticity-inducing counterflow in the main fluid mixing channel.

12. A method of controlling a microfluidic mixer, the method comprising:

activating a number of secondary-channel inertial pumps located within a number of I-shaped secondary channels fluidly coupled to a main microfluidic channel to pump fluids through the secondary channels, wherein at least two I-shaped secondary channels extend from the main microfluidic channel, wherein the inertial pumps located within the I-shaped secondary channels create serpentine flows in the direction of the main microfluidic channel flow or to create vorticity-inducing counterflow in the main microfluidic channel; and activating an inertial pump within a first I-shaped secondary channel located axially offset from, and on opposite sides of the main microfluidic channel from, a second I-shaped secondary channel, at a different time with respect to activation of an inertial pump in the second I-shaped secondary channel, to create the serpentine flows in the direction of the main microfluidic channel flow.

* * * * *